US005322135A

United States Patent [19]

Travis

[11] Patent Number: 5,322,135

[45] Date of Patent: Jun. 21, 1994

[54] OPEN HOLE CORING METHOD

[75] Inventor: J. Deck Travis, Kingwood, Tex.

[73] Assignee: Meridian Oil, Inc., Houston, Tex.

[21] Appl. No.: 96,779

[22] Filed: Jul. 23, 1993

[51] Int. Cl.[5] ..... E21B 49/00

[52] U.S. Cl. ..... 175/58

[58] Field of Search ..... 175/58, 45, 46, 246, 175/309; 166/117.5, 117.6

[56] References Cited

U.S. PATENT DOCUMENTS 5,029,653 7/1991 Jurgens et al. ..... 175/58
5,163,522 11/1992 Eaton et al. ..... 175/58
5,209,309 5/1993 Wilson ..... 175/58
5,211,715 5/1993 Braden et al. ..... 175/58

*Primary Examiner*—Thuy M. Bui

[57] ABSTRACT

A method for obtaining cores from an open borehole including rotary drilling a borehole, replacing the drill bit with an open face whipstock secured to the lower end of the drill string, positioning the whipstock above the formation to be cored and running a coiled tubing unit carrying a drilling motor and coring bit down the interior of the drill string and past the whipstock into the formation at an angle to the axis of the drill string and open hole.

5 Claims, 3 Drawing Sheets

OPEN HOLE CORING METHOD

FIELD OF THE INVENTION

This invention relates to obtaining core samples from subterranean formations, and particularly to obtaining such cores from open holes at positions away from contamination by drilling operations in the borehole.

BACKGROUND OF THE INVENTION

The usefulness of cores of substantial length and in uncontaminated condition is well known in the oil and gas drilling arts. Sidewall coring produces cores of short length (on the order of one to two inches) from the side of an open hole and can sometimes become contaminated by the fluids used in drilling the borehole. Additionally, the smaller the core sample, the faster gases and fluids from a formation core can be lost. The industry has sought methods to obtain longer cores taken away from the borehole which may be retrieved rapidly to the surface. Additionally, the industry has sought economical solutions to the problem of separate "guide" or "carrier" strings of pipe or casing normally used in connection with other coring methods.

SUMMARY OF THE INVENTION

The invention is a method for obtaining core samples including drilling a conventional open generally vertical borehole, replacing the drill bit with an open face whipstock at the lower end of the drill string, the face of the whipstock being at an angle of ¼ degrees to 3 degrees from the axis of the drill string, removably positioning the drill string and whipstock above a formation to be cored, running a coiled tubing unit carrying a coring bit and drilling motor down the interior of the drill string past the whipstock and angularly into an undrilled portion of the formation, and retrieving the core.

The method may include repositioning the whipstock with the drill string and repeating the running and retrieving steps without taking the drill string out of the borehole. By simply repositioning the whipstock by moving the drill string, cores from shallower or deeper zones of interest can be rapidly obtained and retrieved with the coiled tubing unit without the necessity of time-consuming trips caused by withdrawing and stacking carrier or casing pipe.

BRIEF DESCRIPTION OF THE DRAWINGS

Reference is now made to the drawings, in which.

DESCRIPTION OF THE PREFERRED EMBODIMENT

Figure 1:
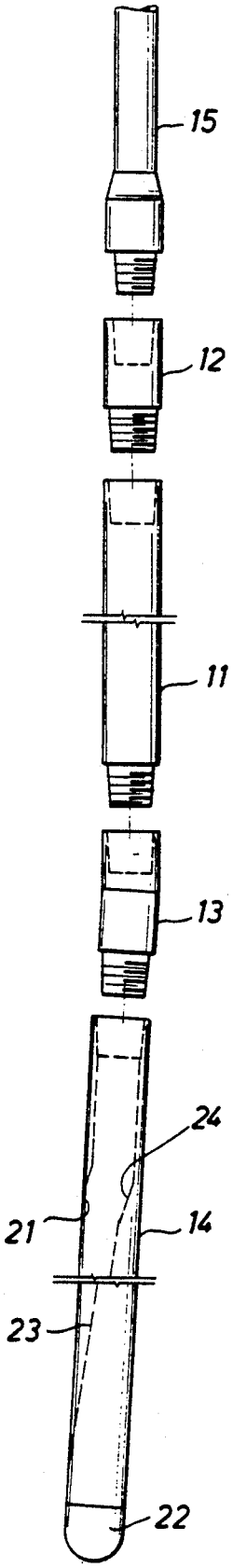
FIG. 1 is a schematic view of the whipstock assembly and its relation to the string of drill pipe which supports it in an open hole.

Referring now to FIG. 1, the whipstock assembly, generally designated by the numeral 10 is schematically shown. Whipstock assembly 10 comprises a crossover sub 12, a length of casing 11, a bent sub 13 and the whipstock 14. Each of the parts of whipstock assembly 10 includes box connections at their upper ends and pin connections in their lower ends to join and support each piece with the part immediately above it and to support crossover sub 12 with the drill string 15. Drill string 15 preferably takes the form of conventional drill pipe, nominally 4⅝ inches to 4⅞ inches outside diameter, which has been used to drill the open hole to about 7⅞ inches. The inside diameter of such pipe should be a minimum of about 3.25 inches to accommodate a coiled tubing assembly of about 3.0 inches outside diameter. However, any diameter of drill pipe from 3½ inches outside diameter or larger can be used. Slim hole pipe of 3½ inches outside diameter could accommodate a coiled tubing assembly of about 1.89 inches outside diameter.

Figure 2:
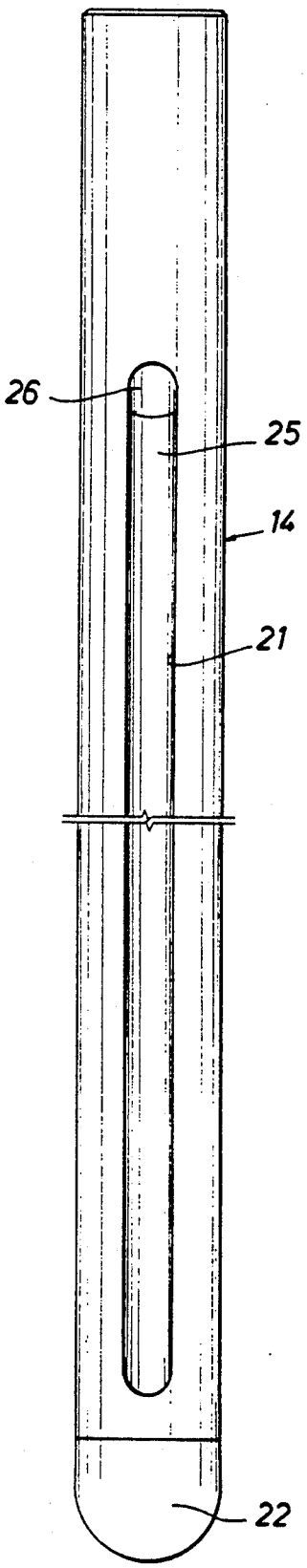
FIG. 2 is a front elevation view of the whipstock.
Figure 3:
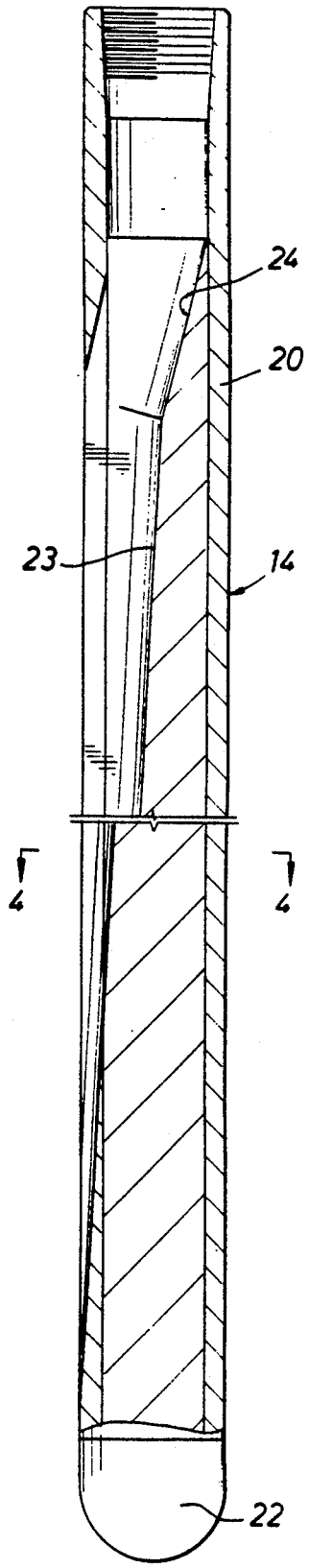
FIG. 3 is a side elevation view of the whipstock in partial cross-section.
Figure 4:
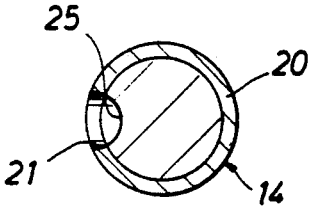
FIG. 4 is a cross-sectional view of the whipstock taken along 4—4 in FIG. 3.
Figure 7:
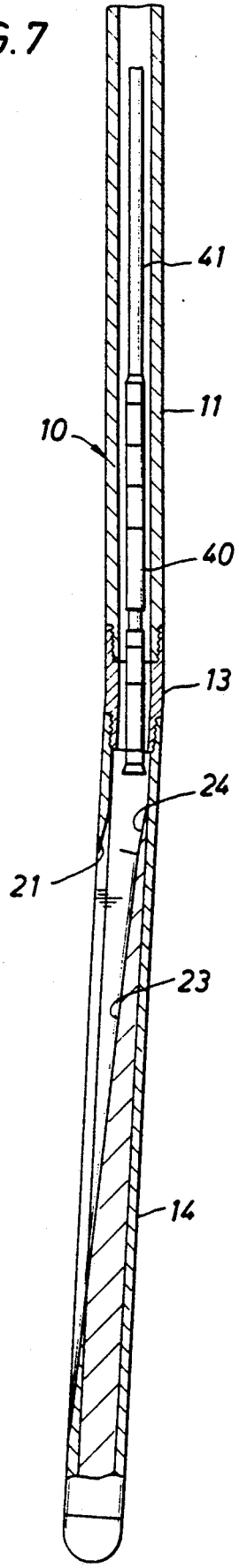

Referring now to FIGS. 2, 3 and 4, whipstock 14 may be constructed of a length of whipstock casing 20 having an inside diameter of about 5½ inches and an outside diameter of about 5 to about 7 inches. An elongated slot 21 is milled along one side of whipstock casing 20 to permit the emergence of the coring assembly (to be described below) into the wall of a drilled open hole. Whipstock casing 20 may be sealed at its lower end by a bullnose 22 or other appropriate closure. Within whipstock casing 20, a whipstock face 23 and a whipstock ramp 24 form the means to urge a coring assembly angularly away from the axis of drill string 15.

As a coring assembly traverses downwardly through drill string 15 and enters whipstock assembly 10, the lower extremity of the coring assembly contacts whipstock ramp 24, having a concave ramp guide 26, and is moved laterally toward elongated slot 21 and the wall of the borehole (not shown). The coring assembly then contacts whipstock face 23 which includes a concave coring guide 25 to align the coring assembly and guide it toward and out elongated slot 21 and toward the wall of the borehole. FIG. 4 shows a cross section of whipstock 14 along line 4—4 in FIG. 3 and shows the arrangement of whipstock face 23, coring guide 25 and elongated slot 21.

Figure 5:
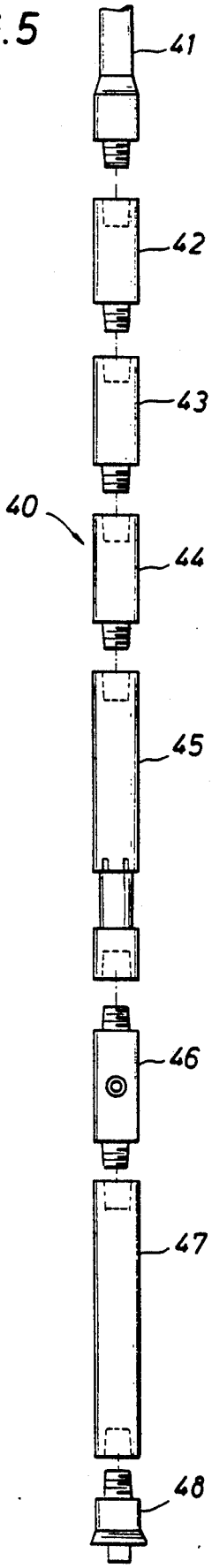
FIG. 5 is a schematic disassembled view of the coil tubing assembly, including mud motor, flow diverter and coring assembly.

FIG. 5 shows a conventional coil tubing coring assembly generally designated by the numeral 40. Coil tubing assembly 40 includes a carrying tool 42, an hydraulic release 43, a pump out sub 44, a mud motor 45, a flow diverter 46, a core barrel 47 and a core bit 48. Core Assembly 40 is supported by a length of relatively flexible coil tubing 41, which extends to the drilling rig floor (not shown). On the rig floor a conventional tubing injection unit, stuffing box and reel of coiled tubing connected to a mud pump raise and lower the coil tubing and furnish mud to mud motor 45 and coring bit 48.

Referring now to FIGS. 6–9, drill string 15 has been pulled from the open borehole after drilling thereof and the drill bit, along with any drill collars, has been replaced by whipstock assembly 10. Open hole drilling logs have been performed to determine the areas from which cores are desired. Whipstock assembly 10 is lowered on the drill string to a position slightly above the stratum to be cored. Magnetic or radioactive inserts (not shown) may be included in casing 11 (FIG. 1) to determine the appropriate direction for coring assembly 40 to be urged by whipstock face. Such directional locators are in common use and well known to those skilled in the drilling arts.

Figure 6:
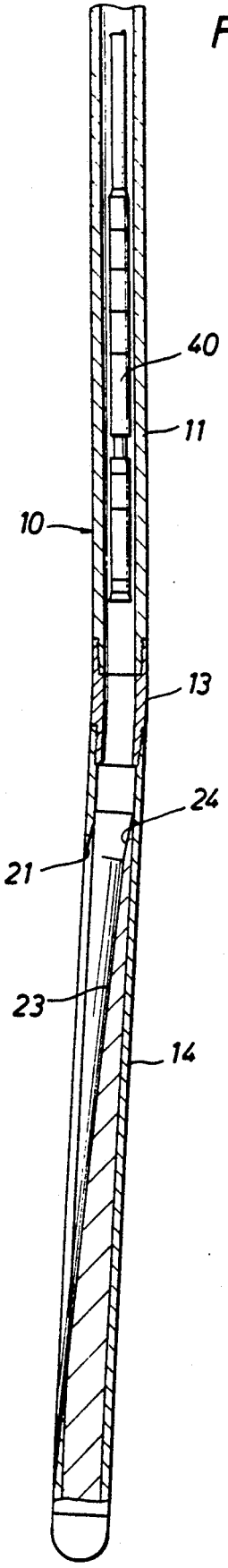
FIGS. 6–9 are side elevation views of the coil tubing coring assembly (6) passing through the whipstock assembly (shown in cross-section), (7) entering the whipstock, (8) contacting the whipstock ramp and face, and (9) exiting the elongated slot of the whipstock above a stratum to be cored.
Figure 8:
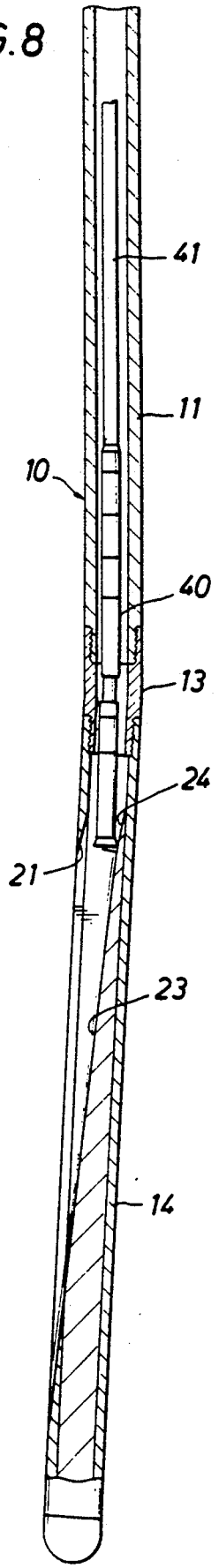
Figure 9:
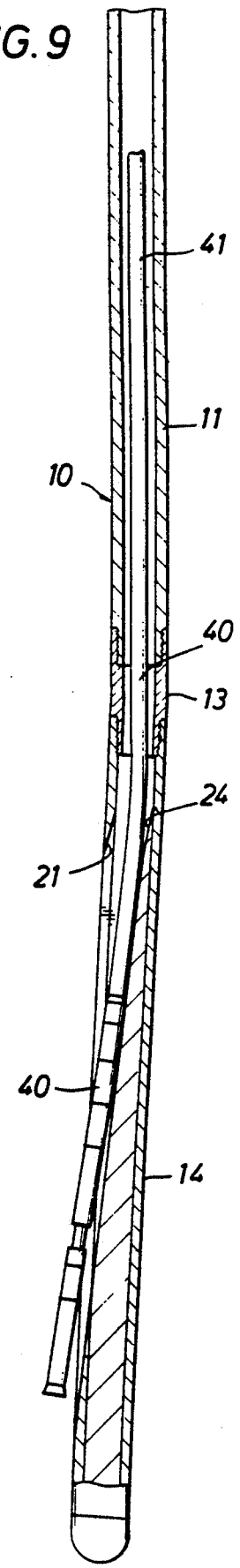

FIG. 6 shows the positioned whipstock assembly 10 in open the borehole. From the surface the coring assembly has been lowered down the drill string, past casing 11 and bent sub 13 and into contact with whipstock ramp 24. Whipstock ramp 24 moves the lowermost portion of coring assembly 40, core bit 48, laterally at a relatively high rate as compared to whipstock face 23. As shown in FIG. 8, coring assembly 40 then contacts whipstock face 23 and is guided toward elongated slot 21 by the concave surface of coring guide 25 (FIGS. 3 and 4). FIG. 9 shows the coring assembly emerging from elongated slot 21 and into undrilled strata angularly away from the axis of the borehole and drill string 15. Coring assembly 40 then continues at the angle established by whipstock face 23 until it reaches the stratum desired to be cored. When that stratum is penetrated, the core thus obtained is secured in core barrel 47 (FIG. 5) and coring assembly 40 is returned to the surface in order to retrieve the core.

If more than one core is desired from the same formation, drill string 15 and whipstock 14 may be rotated and the coring assembly may be rerun in the hole to penetrate the desired stratum at a different angle. If one or more cores from another stratum are desired, drill string 15 may be raised or lowered and coring assembly 40 rerun through the repositioned whipstock assembly 14. Preferably, the entire coring assembly 41 should pass into whipstock 14 prior to complete emergence of the coring bit out of elongated slot 21. In that way substantially all of the blending of the coil tubing unit will be absorbed by coil tubing 41.

The length and angles of whipstock ramp 24 and whipstock face 23 must be such to cause the gradual emergence of coring assembly 41 from whipstock 14 and into the side of the borehole. The angle of bent sub 13 (FIG. 1) is preferably about one degree to about 2½ degrees relative to the axis of drill string 15. Bent sub 13 causes whipstock 14 to be carried at such an angle relative to drill string 15. The angle of whipstock ramp 24 is preferably about 6 degrees to about 12 degrees relative to the axis of whipstock 14 and the angle of whipstock face 23 is about ¼ degrees to about 3 degrees relative to the axis of whipstock 14. It has been found that a whipstock ramp of about 6 degrees from the axis of the whipstock and a whipstock face about two feet longer than coring assembly 40 at an angle of from about ¼ degree to about 3 degrees produces smooth passage of coring assembly 40 past the whipstock and into the borehole wall. It is believed that a coring assembly 40 of about 9 feet minimum length, together with a whipstock face of 10½ feet in minimum length, would be the shortest length equipment in which the present method could be effectively used.

The parts of coring assembly 40 are relatively inflexible compared to coil tubing 41, and care must be taken in establishing the length of whipstock 14 so that coring assembly 40 is gradually urged away from the axis of drill string 15 as it passes through whipstock 14. The coring assembly should be shorter than the face of whipstock 14 so that the bending movement of coring assembly 40 emerging toward the wall of the borehole is absorbed by the more flexible coil tubing 41.

The cores obtained by the present method from an area of the desired formation, uncontaminated by operations in the borehole, can be quickly transported to the surface and analyzed prior to substantial loss of formation fluids. Thus, a unique method of open hole coring has been shown and described. Parts of the apparatus may be modified or rearranged or mechanical equivalents of such parts utilized without departing from the scope of the invention.

What is claimed is:

1. In a method for obtaining core samples from a subterranean stratum comprising:

rotary drilling by means of a drill string and a rotary bit a generally vertical borehole to a desired depth;

removing the rotary bit from the drill string;

replacing the rotary bit with an open face whipstock secured to the lower end of said drill string, the face of said whipstock being at an angle of about ¼ degrees to about 3 degrees to the axis of said drill string;

temporarily positioning said whipstock above a stratum to be cored;

running a coiled tubing unit carrying a drilling motor and coring bit down the interior of said drill string past said whipstock, and angularly away from the axis of said borehole into an undrilled portion of said stratum; and retrieving the core from said coring bit.

2. The method as claimed in claim 1, including the additional steps of:

repositioning said whipstock by manipulating said drill string without removing said drill string from said borehole; and repeating said running and retrieving steps.

3. The method as claimed in claim 1, including the additional step of:

milling a starter hole for said coring bit prior to said running step with said coiled tubing unit from the positioned whipstock which does not pierce said stratum.

4. The method as claimed in claim 1, wherein said running step includes the additional step of:

moving the lower extermity of said coring bit laterally at the top of the face of the positioned whipstock so that said coring bit and drilling motor engage said face of said whipstock and begin travel toward the wall of said borehole prior to being so urged by said face of said whipstock.

5. The method as claimed in claim 1, wherein said running stop includes the additional step of:

passing the entire coring assembly including said drilling motor and coring bit into said whipstock prior to the complete emergence of said coring bit laterally from said whipstock.

* * * * *